US008277608B2

(12) United States Patent
Henricson et al.

(10) Patent No.: US 8,277,608 B2
(45) Date of Patent: Oct. 2, 2012

(54) METHOD FOR TREATING PULP IN CONNECTION WITH THE BLEACHING OF CHEMICAL PULP

(75) Inventors: Kaj Henricson, Helsinki (FI); Olavi Pikka, Karhula (FI); Pekka Tervola, Espoo (FI)

(73) Assignee: Andritz Oy, Kotka (FI)

( * ) Notice: Subject to any disclaimer, the term of this patent is extended or adjusted under 35 U.S.C. 154(b) by 1142 days.

(21) Appl. No.: 10/595,053

(22) PCT Filed: Jun. 17, 2004

(86) PCT No.: PCT/FI2004/000373

§ 371 (c)(1),
(2), (4) Date: Apr. 11, 2007

(87) PCT Pub. No.: WO2005/001196

PCT Pub. Date: Jan. 6, 2005

(65) Prior Publication Data

US 2007/0295462 A1 Dec. 27, 2007

(30) Foreign Application Priority Data

Jun. 30, 2003 (FI) ..... 20030984

(51) Int. Cl.
*D21C 9/02* (2006.01)

(52) U.S. Cl. ..... 162/60

(58) Field of Classification Search ..... 162/60
See application file for complete search history.

(56) References Cited

U.S. PATENT DOCUMENTS 4,104,114 A 8/1978 Rowlandson et al.
4,529,479 A 7/1985 Tuomi
4,664,749 A 5/1987 Haapamaki et al.
4,919,158 A 4/1990 Kokkonen et al.
5,051,195 A 9/1991 Haapamaki et al.

(Continued)

FOREIGN PATENT DOCUMENTS

RU 94046173 A1 9/1996

(Continued)

OTHER PUBLICATIONS

Markku Perkola et al, "The Drum Displacer—A New Approach to Brownstock Washing", Feb. 1989 Tappi Journal, pp. 91-95.

(Continued)

*Primary Examiner* — Eric Hug
*Assistant Examiner* — Jacob Thomas Minskey
(74) *Attorney, Agent, or Firm* — Nixon & Vanderhye P.C.

(57) ABSTRACT

A method of treating pulp in connection with the bleaching of chemical pulp, said method including treating of the pulp in at least an ozone, chlorine dioxide or alkali phase and thereafter washing of the pulp in a washing device having an $E_{10}$ value of at least 3, whereby washing liquid is introduced into the washing device countercurrently in relation to the pulp and filtrate is discharged from the washing device. At first the pulp is washed in the washing device so that the washing liquid is filtrate obtained from the washing device itself and the amount of thus circulated washing liquid is 1.5 - 3.5 t/adt pulp, whereafter the pulp is washed with liquid introduced from outside the washing device, the amount of said liquid being such that the dilution factor in the latter wash is less than 1 t/adt and that the total amount of washing liquid used in the washing device is such that the dilution factor is more than 0 t/adt.

17 Claims, 2 Drawing Sheets

U.S. PATENT DOCUMENTS 5,415,734 A 5/1995 Backlund et al.

FOREIGN PATENT DOCUMENTS

| | | | | |
|---|---|---|---|---|
| SU | 265020 | A1 | | 1/1970 |
| WO | 92/22702 | A1 | | 12/1992 |
| WO | 93/23607 | A1 | | 11/1993 |
| WO | 97/10379 | A1 | | 3/1997 |
| WO | WO 97/10379 | | * | 3/1997 |

OTHER PUBLICATIONS

Johan Gullichsen et al., "Chemical Pulping", Papermaking Science and Technology, Book 6A, pp. 1-9, 1999.

International Search Report for PCT/FI2004/0000373 dated Oct. 5, 2004.

* cited by examiner

METHOD FOR TREATING PULP IN CONNECTION WITH THE BLEACHING OF CHEMICAL PULP

BACKGROUND AND SUMMARY OF INVENTION

This application is the U.S. national phase of international application PCT/FI2004/000373 filed 17 Jun. 2004 which designated the U.S. and claims benefit of FI 20030984, dated 30 Jun. 2003, the entire content of which is hereby incorporated by reference.

The present invention relates to a method of reducing the amount of fresh water required for washing pulp in the bleaching of chemical pulp. Sulfate pulp is most often bleached in a multistage bleaching plant, where the pulp is washed between the bleaching stages. Typically the washing is carried out by either pressing or by displacement washing. The present invention relates to intensifying the washing in the bleaching of sulfate pulp between the bleaching stages, when the washing is carried out using a washing device applying displacement. The displacement may be effected by means of e.g. pressure drum washers, washing presses or diffusers.

European patent publication 856079 discloses a method of intensifying the displacement washing of pulp so that at least part of the filtrate from a suction, pressing or thickening stage following the actual washing is directed to an immediately preceding washing stage as washing liquid. Also part of the filtrate from an only or a last stage of washing may be returned to the beginning of said stage to be used as washing liquid. In this way, the amount of washing liquid used for washing pulp may be increased, whereby the washing results are improved compared to a situation, where the same amount of liquid is introduced to the washing without directing the filtrate to the washing.

Finnish patent 67894 describes a washing method in connection with the bleaching of pulp, where bleaching chemical is introduced into the pulp alternately so that it displaces from the pulp the chemical used in a previous stage and displacement chemical is directed into the pulp by means of a washer. The washing is completed in e.g. a two-stage drum washer, in which the liquid displaced in the latter stage is led as displacement liquid into the first stage. Together with the displacement liquid, e.g. alkali is introduced to the first stage. This displacement-alkali treatment may be used to replace the conventional washing apparatus and alkali tower of a chlorination stage. The filtrate from the first stage may be led into a preceding washer.

A method has been developed to reduce the amount of fresh water or other clean washing liquid required for the washing of pulp in connection with bleaching. Specifically, is the method is believed to improve and intensify the washing between bleaching stages so that essentially the same purity of the pulp is reached with reduced amount of fresh water compared to prior art washing processes.

A method of treating pulp in connection with the bleaching of chemical pulp has been developed, which method comprises treating the pulp in at least an ozone, chlorine dioxide or alkali stage and washing the pulp thereafter in a washing device having an $E_{10}$-value of at least 3, preferably more than 4, whereby washing liquid is introduced in the washing device countercurrently in relation to the pulp and filtrate is removed from the washing device. The pulp is washed in the washing device so that the first washing liquid is filtrate obtained from the washing device itself and the amount of said washing liquid is 1.5-3.5 t/adt, whereafter the pulp is washed with a washing liquid introduced into the washing device from outside the device, the amount of said washing liquid being such that the dilution factor in the latter washing is lower than 1 t/adt and the total amount of washing liquid used in the washing device is such that the resulting dilution factor is over 0 t/adt.

The filtrate obtained from the washing device is fractionated to at least two flows. One fraction is preferably obtained from the final part of the filtrate, which forms less than 50%, preferably less than 30% of the filtrate. The fractionating is effected so that in the beginning the filtrates are led via one channel system off the washer and the remaining portion, being circulated inside the washer, is led via a separate channel system into the initial stage of the washing. This latter fraction is used as a filtrate received from the same washing device, with which filtrate the pulp is first washed in the washing device. After this, the pulp is further washed with clean liquid or liquids introduced from outside the washing device, which filtrate preferably is a filtrate from a bleaching stage located in the pulp flow direction later in the process. Said final fraction, which preferably comprises less than 30% of the filtrate to be removed from the process, is generated in the latter wash of the pulp and is thus cleaner than the filtrate received from the "preliminary" washing of the pulp. The amount of said fraction is 1.5-3.5, preferably 1.5-2.5 t/adt.

Thus, the washing stage relates to a single-stage countercurrent wash carried out between the bleaching stages, in which wash the dilution factor is less than 1 t/adt and part of the filtrate from that stage is taken to the beginning of said stage to be used as washing liquid. This treating of pulp with an internally circulated filtrate may be considered as a kind of preliminary washing.

Especially the invention may be applied to the washing of pulp after an ozone stage, chlorine dioxide stage and/or alkali stage. Alkali stages include e.g. E-, EO-, EP-, EOP-, P-, PO- or OP stages. Chlorine dioxide stages include e.g. (DC), C/D, D/C, $D_0$, $D_1$, $D_2$ and $D_3$ stages, with possible addition of chemicals, such as chlorine, EDTA or NaOH.

The method is preferably applicable in connection with the following washing devices: drum washers (preferably Drum Displacer® (DD)-drum washers [Andritz Oy]), diffuser washers, washing presses and suction filters having a washing efficiency of over 3, preferably over 4, typically 3-8, most typically 4-6, expressed as $E_{10}$-value. A sufficiently efficient washing is inevitable in order to obtain from the latter wash a filtrate fraction, which is clean enough to be reused inside the same bleaching stage. The so-called $E_{10}$ value is used to determine the washing efficiency so that washers of different types may be compared with each other. $E_{10}$ value is a figure determined for a washer or a combination of several washers, which expresses how many ideal mixings said washer or combination of washers reaches. An ideal mixing, in its turn, is understood as a situation where the washing liquid is mixed into the pulp being washed so efficiently that the concentrations of both the liquid remaining in the pulp and the liquid removed therefrom are identical. FIG. 10 in an $E_{10}$-value expresses the calculated consistency percentage at which the pulp exits the washer.

What is meant with dilution factor is the difference between used washing liquid and liquid exiting the washing device together with the pulp per a ton of pulp (DF=V2−L2, wherein V2 is the amount of washing liquid t/adt pulp and L2 is the amount of liquid t/adt pulp in the pulp leaving the washing device). The pulp is washed with washing liquid fed in from outside the washing device, the amount of which liquid is according to the invention such that the dilution factor in said final washing is less than 1, preferably less than 0 t/adt, most preferably less than −1 t/adt. The dilution factor of the washing device as a whole is over 0 t/adt, preferably over 1 t/adt.

SUMMARY OF DRAWINGS

The present invention is explained in more detail with reference to the accompanying Figures, of which

DETAILED DESCRIPTION OF INVENTION

Figure 1:
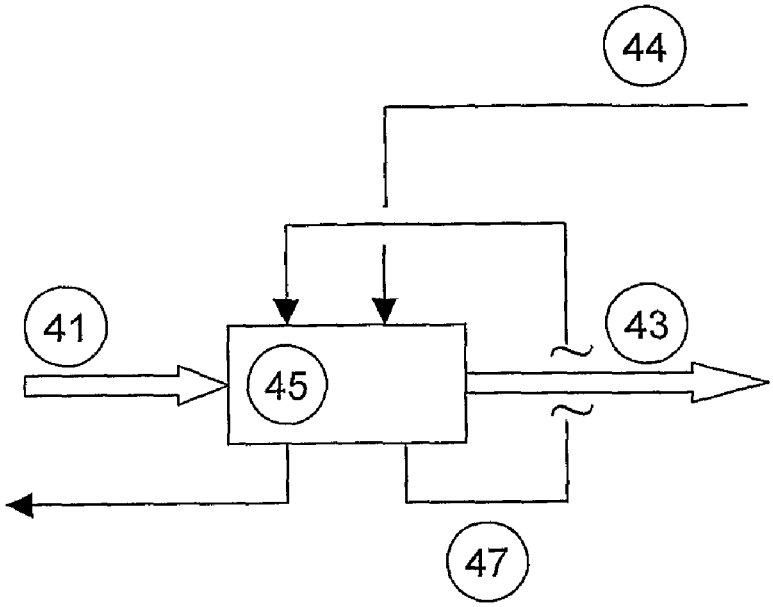
FIG. 1 is a schematic illustration of a preferred embodiment for accomplishing the pre-sent invention.

FIG. 1 shows a washing device 45 for displacement washing. Such washing devices include e.g. diffusers and some filters as well as some DD-washers. Pulp 41 is washed by displacement with washing liquid 44. Part of the washing liquid 44 is replaced with filtrate 47 from the very same stage, with which filtrate the pulp is first washed, and which originates from a later washing of the pulp in the washing device with washing liquid 44 introduced from outside the washing device. Internal circulation of filtrate significantly reduces the amount of washing liquid 44 coming from outside the washing device.

The washed pulp 43 is typically led to a subsequent bleaching stage, and washing filtrate generated in this stage may be used as washing liquid 44.

Figure 2:
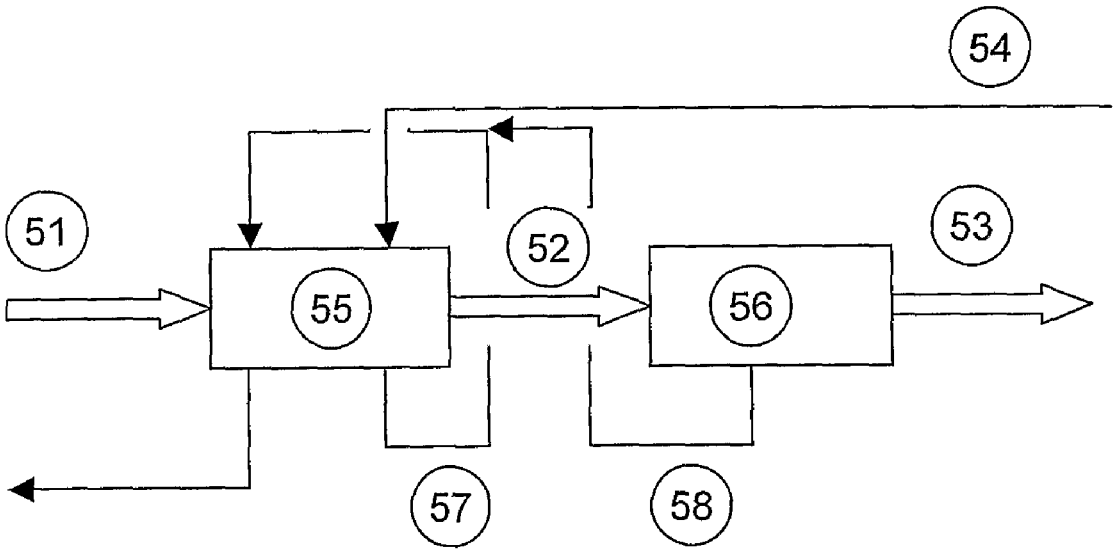
FIG. 2 is a schematic illustration of a second preferred embodiment for accomplishing the present invention.

FIG. 2 illustrates a washing situation in a device, in which the incoming pulp 51 is first washed with washing liquid 54 by displacement 55 and the consistency of the displacement-washed pulp 52 is then raised in a thickening or pressing part 56. When the consistency of the exiting pulp 53 is over 25%, the device is considered to be a washing press. Otherwise it is usually considered to be a filter with a thickening part 56. Examples of this kind of washing devices are e.g. washing presses and some filters as well as some DD-washers.

Part of the washing liquid 54 coming from outside the washing device is replaced with filtrate of the washing stage itself. The internal filtrate of the stage is formed in a displacement part (55) and/or pressing/thickening part (56). The pulp 51 introduced to the washing device is first washed with this filtrate. This significantly decreases the amount of washing liquid 54 introduced from outside.

The pulp is first washed with the internal filtrate of the washing device and then with washing liquid introduced from outside the washing device, the amount of which liquid is such that the dilution factor in the latter wash is less than 1, preferably less than 0, most preferably less than −1. The dilution factor, also known as washing water surplus, is the washing liquid flow (44, 54) minus the amount of liquid entrained in the exiting pulp flow (43, 53) where the unit is t/adt. Example: The incoming liquid flow (44) is 7 t/adt. The consistency of the exiting pulp flow is 10%, i.e. the exiting flow (43) is 1 bdt of pulp and 9 t of liquid/bdt or 0.9 t of adt pulp and 8.1 t of liquid/adt. (bdt=bound dry ton pulp, i.e. 100% pulp, adt=air dry ton pulp, i.e. 90% pulp, i.e. 900 kg pulp). Thus, the dilution factor is 7−8.1=−1.1 when the unit is t/adt.

The combined washing liquid amount required for the washing device (in conduit 44 and 47 of FIG. 1; conduits 54, 57 and 58 of FIG. 2) is such that the dilution factor is more than 0 t/adt, preferably more than 1.0 t/adt, typically 0-6 t/adt, most typically 1-4 t/adt. The invention, the washer uses filtrate (47) from its own bleaching stage, e.g. 2.5 t/adt and thus we end up with a dilution factor for the whole washing operation (47, 44) of −1.1+2.5=1.4 t/adt. Normal dilution factors for bleaching are in the range of 1-3. That is, the method achieves the same dilution factor level as is normal in a displacement operation, while the amount of liquid introduced from outside is much smaller than normally expressed as dilution factor (−1.1 t/adt). In bleaching technology, this provides for an excellent chance to decrease the use of fresh water by 1.5-3.5 ton/washer/ton of pulp. A bleaching plant usually has 3-5 bleaching stages. When the method is applied e.g. to two stages, the obtained saving in water is 3-7 tons per ton of pulp, which is very significant considering that typically the total water consumption in a bleaching plant is 10-20 t/adt.

Balance calculations have shown that reusing water inside one and the same bleaching stage in practice leads to the same washing result as when using only externally-introduced washing liquid, as long as the total dilution factor is the same and the efficiency of the washing device is high enough to ensure an adequate purity of the circulated filtrate fraction. This is a surprising result, as the art has always taught that without an adequate amount of water introduced from outside it is not possible to reach a satisfactory washing result between bleaching stages. This newly invented method of washing will, however, remarkably decrease the water consumption of bleaching plants without significant additional investments.

By providing for one simple liquid circulation around a washing stage, the need for fresh water and the amount of effluent is decreased by tens of percent. At the same, also a saving in thermal energy is achieved as the circulating liquid has just the proper temperature.

Figure 3:
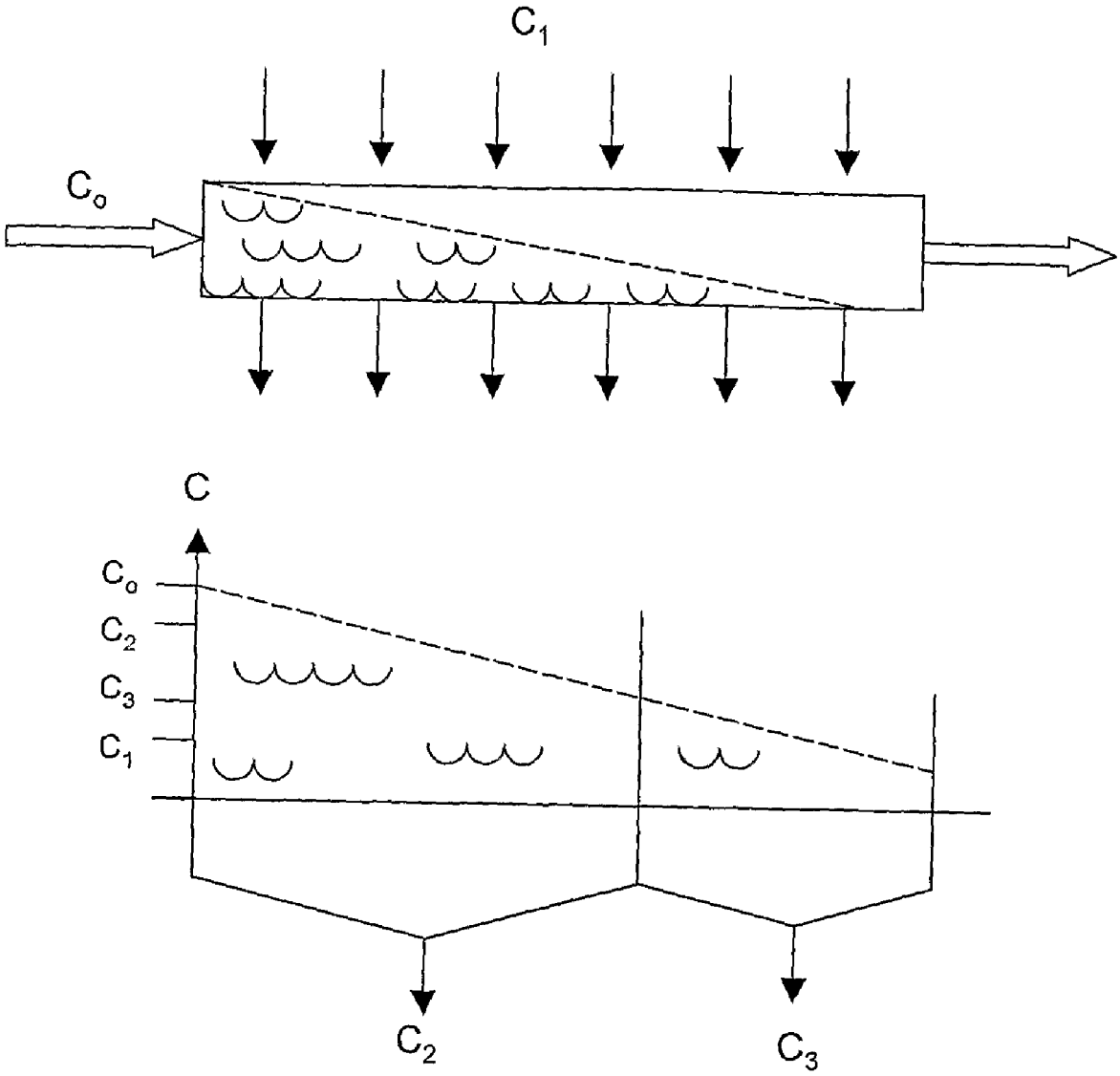
FIG. 3 illustrates a displacement situation in the pulp pathway in the flow direction of the pulp.

FIG. 3 illustrates a displacement operation in the pulp web inside the washer in the flow direction of the pulp. The liquid of the incoming pulp has a chemical content $C_0$. The pulp is washed with a washing liquid having a chemical content $C_1$. A first filtrate fraction having a chemical content $C_2$ is thus formed. At the end of the wash, a filtrate fraction with a content $C_3$ is formed.

This newly invented method presupposes that fraction $C_3$, which forms less than 50%, preferably less than 30% of the final portion of the filtrate is pure enough or close to a content of $C_1$, in order to be circulated and used in the initial washing of pulp in the washing device. This is achieved when the liquid volume of $C_3$ is 1.5-3.5 t/adt and the displacement is efficient enough, i.e. over 3, preferably over 4 expressed as value $E_{10}$.

A further requirement is that the total amount of liquid used in the displacement is adequate, whereby a total dilution factor of more than 0, preferably more than 1 is required. Otherwise a sufficient penetration of the externally introduced clean liquid $C_1$ through the pulp web into fraction $C_3$ is not possible.

A feature of recirculating wash liquid filtrate is that in bleaching the use of water, especially fresh water, coming from outside a stage, may be decreased in a way the washing is completed under a shortage of washing water. Poor washing may result between bleaching stages, if the internal circulation inside a washing stage would not be practiced.

Washing under a shortage of washing water is usually not possible. For example, in brown stock washing, where the desired washing results are over 99% and where the $E_{10}$-value of the whole washing plant may be over 20, the differences between washing water fractions are relatively small. Thus, an internal filtrate circulation does not provide for such an advantage that the pulp could be washed under a shortage of washing water. The dilution factor must further be in the range of 2-4 t/adt for fresh water introduced from outside.

The method is especially suitable for bleaching, where washing between two bleaching stages is accomplished by displacement washing and the pH-values and other conditions of the bleaching stages are different from each other, whereby vast differences between filtrate fractions in view of pH, temperature or some other property are obtained. That is, the filtrate to be circulated differs essentially from the rest of the filtrate in view of concentration, pH or temperature. We may say that the properties of the filtrate to be circulated must resemble the properties of externally introduced washing water more than the properties of the filtrate being discharged from the washing device. This may also be described so that if a property of externally introduced washing water is C0 and the corresponding property entering with the pulp is C1, the difference in properties is C1−C0. The property of the filtrate to be circulated Ccirculation=C0+kx(C1−C0), where k is less than 0.35, preferably 0.2. Here C may be a chemical content or a corresponding property.

The present invention may preferably be applied e.g. in connection with bleaching sequences $A/D_0$−EOP−$D_1$−$D_2$ and $A/D_0$−EOP−$D_1$−P. When the washing according to the invention is completed after sequences $A/D_0$, EOP and $D_1$, the effluent amount may be decreased by about 25% compared to a situation devoid of an internal circulation of filtrate according to the invention. In bleaching the purity of incoming and exiting pulp remains essentially the same independent of whether the pulp is washed according to the invention or conventionally using remarkably more washing water from outside the washing device.

What is claimed is:

1. A method for treating pulp in connection with the bleaching of chemical pulp, said method comprising:

at least treating the pulp in an ozone, a chlorine dioxide or an alkali stage and washing the pulp thereafter in a washing device having an $E_{10}$-value of at least 3, whereby washing liquid is introduced into the washing device counter-currently in relation to the pulp and a washing liquid filtrate is discharged from the washing device, wherein the pulp is washed in the washing device using a first washing liquid consisting of the washing liquid filtrate obtained from the washing device, wherein an amount of the washing liquid filtrate in the first washing liquid is in a range of 1.5 t/adt pulp to 3.5 t/adt pulp, thereafter the pulp is washed with a second washing liquid consisting of washing liquid introduced from outside the washing device, wherein an amount of said second washing liquid being such that a dilution factor in the second washing liquid is less than 1 t/adt and a total amount of the first washing liquid and the second washing liquid used in the washing device is such that the dilution factor is over 0 t/adt.

2. A method according to claim 1, wherein the amount of washing liquid filtrate used in the first washing liquid is in a range of 1.5 to 2.5 t/adt.

3. A method according to claim 1 wherein the filtrate obtained from the washing device is fractionated into at least two flows, at least one of which is in a range of 1.5 t/adt to 3.5 t/adt and is formed of a final part of filtrate exiting the washing device, wherein the final part comprises less than 50% of the total exiting filtrate amount and which is used for the first washing liquid of the pulp.

4. A method according to claim 3 wherein the final part comprises less than 30% of the total exiting filtrate.

5. A method according to claim 1 wherein the dilution factor in the second washing liquid is less than 0 t/adt

6. A method according to claim 1 wherein the $E_{10}$-value is at least 4.

7. A method according to claim 1 wherein the dilution factor in the latter was is less than −1 t/adt.

8. A method for treating a chemical pulp comprising:

treating the pulp in a bleaching stage;

washing the treated pulp in a washing device having an $E_{10}$-value of at least 3, whereby a first washing liquid is introduced into the washing device counter-currently to the pulp;

discharging a filtrate from the washing device, wherein the pulp is washed in the washing device so that the first washing liquid consists of a filtrate circulated from the washing device and an amount of the circulated filtrate is 1.5-3.5 t/adt pulp, and subsequently washing the pulp with a second washing liquid consisting of wash liquid introduced from outside the washing device, wherein an amount of said second washing liquid is such that a dilution factor for the second washing liquid is less than 1 t/adt, and that a total amount of the first washing liquid and the second washing liquid in the washing device is such that the dilution factor is over 0 t/adt.

9. The method in claim 8 wherein the bleaching stage further comprises at least one of an ozone, a chlorine dioxide and an alkali.

10. The method in claim 8 wherein the washing device is a displacement washing device.

11. The method in claim 10 wherein the displacement washing device is at least one of a pressure drum washer, a washing press or a diffuser.

12. The method in claim 8 wherein the amount of circulated washing filtrate used in the first washing liquid is between 1.5 t/adt to 2.5 t/adt.

13. The method according to claim 8 wherein the filtrate obtained from the washing device is fractionated into at least two flows, at least one of which flows is in a range of 1.5 t/adt to 3.5 t/adt and is formed of a final part of filtrate exiting the washing device, which final part comprises less than 50% of a total exiting filtrate amount and is used for the first wash of the pulp.

14. The method according to claim 13 wherein the final part comprises less than 30% of the total exiting filtrate amount.

15. The method according to claim 8 wherein the dilution factor in the latter wash is less than 0 t/adt.

16. The method according to claim 8 wherein the dilution factor in the latter wash is less than −1 t/adt.

17. The method according to claim 8 wherein the $E_{10}$ -value is at least 4.

* * * * *